US009783764B2

(12) United States Patent
Leon Navarro et al.

(10) Patent No.: US 9,783,764 B2
(45) Date of Patent: Oct. 10, 2017

(54) FABRIC CONDITIONER

(71) Applicant: Colgate-Palmolive Company, Piscataway, NJ (US)

(72) Inventors: Juan Antonio Leon Navarro, Mexico City (MX); Jose Javier Tovar Pescador, Mexico City (MX); Oscar Bautista Cid, Mexico City (MX)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/654,658

(22) PCT Filed: Dec. 21, 2012

(86) PCT No.: PCT/US2012/071264

§ 371 (c)(1),
(2) Date: Jun. 22, 2015

(87) PCT Pub. No.: WO2014/095596

PCT Pub. Date: Jun. 26, 2014

(65) Prior Publication Data

US 2015/0337240 A1 Nov. 26, 2015

(51) Int. Cl.
*C11D 3/37* (2006.01)
*C11D 3/00* (2006.01)

(52) U.S. Cl.
CPC ..... *C11D 3/001* (2013.01); *C11D 3/3742* (2013.01)

(58) Field of Classification Search
CPC ..... C11D 3/001
USPC ..... 510/515
See application file for complete search history.

(56) References Cited

U.S. PATENT DOCUMENTS 4,800,026 A * 1/1989 Coffindaffer ..... C11D 3/0015 510/516
4,806,345 A 2/1989 Bhattacharyya
4,908,140 A * 3/1990 Bausch ..... C11D 1/62 510/516
4,911,852 A * 3/1990 Coffindaffer ..... D06M 15/6436 427/393.2
5,064,543 A * 11/1991 Coffindaffer ..... D06M 13/005 252/8.91
5,147,578 A * 9/1992 Kirk ..... B01D 19/0409 510/513
5,336,419 A * 8/1994 Coffindaffer ..... C11D 3/3742 510/274
6,864,223 B2 3/2005 Smith et al.
2008/0209645 A1* 9/2008 Carrillo ..... C11D 1/008 8/137
2012/0168664 A1* 7/2012 Maurer ..... C08G 77/38 252/8.57
2015/0337240 A1* 11/2015 Leon Navarro ..... C11D 3/3742 510/515
2016/0017261 A1* 1/2016 Bautista Cid ..... C11D 3/3742 8/137

FOREIGN PATENT DOCUMENTS

| | | |
|---|---|---|
| CN | 101509196 | 8/2009 |
| EP | 0363346 | 4/1990 |
| WO | WO 90/12862 | 11/1990 |
| WO | WO 91/19037 | 12/1991 |
| WO | WO 2004/041983 A1 | 5/2004 |
| WO | WO 2005/042829 | 5/2005 |

OTHER PUBLICATIONS

Qiu Feng et al. Journal of Donhua University. (Eng. Ed), vol. 28, No. 4, 2011.*
International Search Report and Written Opinion for International Application No. PCT/US2012/071264 mailed on Sep. 23, 2013.

* cited by examiner

*Primary Examiner* — Nicole M Buie-Hatcher
*Assistant Examiner* — M. Reza Asdjodi

(57) ABSTRACT

A fabric conditioner composition comprising an amino-functional, epoxide group containing silicone polymer having a weight average molecular weight of 400,000 to 900,000 a branched amine functional silicone. The branched amine functional silicone can be of structure $R_3SiO(RSi((CH2)aR')O)_m(RSi(OR''))_n(R_2SiO)_pSiR_3$. The combination of the amino-functional, epoxide group containing silicone polymer and amine functional silicone can to reduce time needed for drying fabric, reducing color fading of fabric during laundering, reducing pilling of fabric, and reducing force needed to iron fabric.

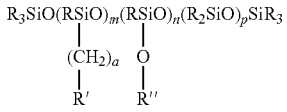

25 Claims, No Drawings

FABRIC CONDITIONER

BACKGROUND OF THE INVENTION

After laundering of fabric, fabric is rinsed and dried. Drying can be done by line drying or dryer drying. In a dryer, the longer the drying time, the more energy that is used to dry the fabric. Also, after multiple washings, fabric color can fade and the fabric can exhibit pilling. Additionally, garments can be ironed to remove wrinkles. Ironing requires force to move the iron across the fabric. It would be desirable to reduce the time needed to dry fabric, reduce color fading, reduce pilling, reduce the force needed to iron fabric, and/or reducing wrinkles in fabric.

BRIEF SUMMARY OF THE INVENTION

A fabric conditioner composition comprising an amino-functional, epoxide group containing silicone polymer having a weight average molecular weight of 400,000 to 900,000 and a branched amine functional silicone. The branched amine functional silicone can be of structure

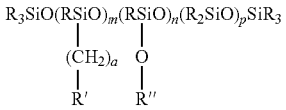

R is a $C_1$-$C_4$ alkyl group,
R' is an amine or salt thereof,
R" is $(R_2SiO)_x$ or $(R_2SiO)_y(RSiO)_w[(CH_2)_3R']_z$,
a is 1 to 10, optionally 1 to 5, 1 to 3, or 3,
m is 1 to 5,
n is 3 to 20,
p is 300 to 500,
x is 50 to 200,
y is 20 to 100,
w is 0 to 10,
z is 0 to 5; and
x+y+w+z+p=500 to 700.

The fabric conditioner can be used in a method to launder fabric to reduce the amount of time needed for drying the fabric.

The fabric conditioner can be used in a method to launder fabric to reduce foam generation during laundering.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

A fabric conditioner composition comprising an amino-functional, epoxide group containing silicone polymer having a weight average molecular weight of 400,000 to 900,000 and a branched amine functional silicone. The branched amine functional silicone can be of structure

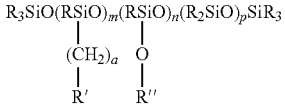

R is a $C_1$-$C_4$ alkyl group,
R' is an amine or salt thereof,
R" is $(R_2SiO)_x$ or $(R_2SiO)_y(RSiO)_w[(CH_2)_3R']_z$,
a is 1 to 10, optionally 1 to 5, 1 to 3, or 3,
m is 1 to 5,
n is 3 to 20,
p is 300 to 500,
x is 50 to 200,
y is 20 to 100,
w is 0 to 10,
z is 0 to 5; and
x+y+w+z+p=500 to 700.

The branched amine functional silicone can be obtained from Provista S.A. de C.V of Mexico as SR2 silicone.

In certain embodiments, the branched amine functional silicone has a weight average molecular weight of 50,000 to 70,000. In certain embodiments, the branched amine functional silicone is not a film forming polymer. In certain embodiments, at least 80% of R groups in (RSiO) or $(R_2SiO)$ moieties are methyl. In certain embodiments, the amine is selected from the group consisting of —$NH_2$, NHR, —$N(R)_2$, —NH—$(CH_2)_b$—$NH_2$, and —$N(R)_3^+$, wherein b is 1 to 6, optionally 1 to 2, or 2, preferably —$NH_2$. In certain embodiments, R" is $(R_2SiO)_x$.

In certain embodiments, the branched amine functional silicone is present in an amount of 0.02 to 2% by weight of the composition, optionally 0.05 to 1.25%, 0.1 to 1.25%, 0.1 to 0.9%, 0.1 to 0.5%, 0.1 to 0.4%, 0.2 to 0.5%, or 0.3 to 0.4% by weight of the composition.

The composition includes an amino-functional, epoxide group containing silicone polymer. In certain embodiments, the polymer is 3-aminopropyl-5,6 epoxycyclohexylethyl-dimethyl polysiloxane. In certain embodiments, the amino-functional, epoxide group containing silicone polymer has a weight average molecular weight of 400,000 to 900,000; 450,000 to 850,000; 500,000 to 800,000; or 510,000 to 800,000. In certain embodiments, the ratio of epoxy groups to the total of all groups in the polymer is 1:300 to 1:500 or 1:350 to 1:400. In one embodiment, the amino-functional, epoxide group containing silicone polymer is available from Provista SA de CV of Mexico as E101 silicone.

The combination of the molecular weight with the level of epoxide groups forms a polymer that forms a soft rubber to provide flexibility to the polymer to provide increased wrinkle reduction on fabrics and to make the polymer more easily processed into an emulsion.

In another embodiment, the amino-functional, epoxide group containing silicone polymer has a low amine content, which is 0.1 to 0.25 meq/g. Amine content can be measured by ASTM D2074. The low amine content does not cause yellowing when the polymer is heat treated, such as when in a dryer. The level of amine content is low enough such that there is substantially no yellowing perceivable to a person when viewing a fabric treated with the amino-functional, epoxide group containing silicone polymer. In other embodiments, the amino-functional, epoxide group containing silicone polymer has at least one of the following properties: a small elastomeric level, a low degree of reticulation, low resilience, low tension resistance, or hydrophilicity. The epoxide group can be a free epoxide group, or it can be part of a crosslink in the polymer.

The amino-functional, epoxide group containing silicone polymer is present in an amount of 0.02 to 0.5%. This is a lower level than is typically used for this polymer. In other embodiments, the amount is at least 0.02 up to 0.03, 0.04, 0.05, 0.06, 0.07, 0.08, 0.09, 0.1, 0.15, 0.2, 0.25, or 0.3% by weight. In one embodiment, the amino-functional, epoxide group containing silicone polymer is present in an amount of 0.245% by weight. In other embodiments, the amount is 0.02 to 0.32%, 0.02 to 0.25% by weight of the composition or 0.02 to 0.245% by weight.

Previous amino-functional silicone polymers were solvent based compositions. Solvent based silicone systems introduce solvent into the wash, which can adhere to fabrics. The amino-functional, epoxide group containing silicone polymer can be provided in an emulsion using cationic and/or nonionic surfactants to make the polymer emulsion water dispersible. In certain embodiments, the composition is free of organic solvents. Organic solvents include those for solubilizing amino-functional silicone polymers.

The amino-functional, epoxide group containing silicone polymer can be provided in an emulsion. The polymer can be emulsified by cationic surfactants, nonionic surfactants, or combinations thereof. Examples of cationic surfactants include monoalkyl quaternary ammonium compounds, such as cetyltrimethylammonium chloride. Examples of nonionic surfactants include alkoxylated (ethoxylated) nonionic surfactants, ethoxylated fatty alcohols (Neodol™ surfactants from Shell or Brij™ surfactants from Uniqema), ethoxylated sorbitan fatty acid ester (Tween surfactants from Uniqema), sorbitan fatty acid esters (Span™ surfactants from Uniqema), or ethoxylated fatty acid esters. In one embodiment, the amino-functional, epoxide group containing silicone polymer is available in an emulsion containing a cationic surfactant from Provista SA de CV of Mexico as E101 silicone. In this embodiment, the amount of polymer in the emulsion is 35% by weight. When provided in an emulsion at 35% by weight, the amount of the silicone in the composition is less than 1% by weight.

The amino-functional, epoxide group containing silicone polymer and amine functional silicone combination reduces the time needed for drying fabric by depositing on the fabric during laundering. The amine groups have an affinity for the fabric and deposit on the fabric. Water on the fabric migrates through the hydrophilic groups on the polymer and then act as a carrier to promote evaporation of the water. The combination also reduces color fading, pilling, the force needed for ironing of fabric, and wrinkle reduction.

The composition can be used during any step of the laundering method. In one embodiment, the composition is added during the wash cycle. In one embodiment, the composition is added during the rinse cycle. The composition can be used at least 3 times or at least 5 times to launder fabric. After multiple washings, the effects of the polymer combination on fabric can be increased.

The fabric conditioner can also contain a cationic fabric softener. In certain embodiments, the softener is a cationic softener selected from among esterquats, imidazolinium quats, difatty diamide ammonium methyl sulfate, ditallow dimethyl ammonium chloride, and mixtures thereof.

In certain embodiments, the cationic fabric softener is an esterquat. Esterquats can be of the formula:

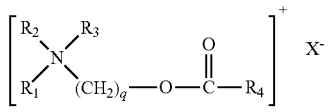

wherein $R_4$ is an aliphatic hydrocarbon group having from 8 to 22 carbon atoms, $R_2$ and $R_3$ represent $(CH_2)_s$—$R_5$, where $R_5$ is an alkoxy carbonyl group containing from 8 to 22 carbon atoms, benzyl, phenyl, $C_1$-$C_4$ alkyl substituted phenyl, OH or H; $R_1$ is $(CH_2)_t$—$R_6$, where $R_6$ is benzyl, phenyl, $C_1$-$C_4$ alkyl substituted phenyl, OH or H; q, s, and t, each independently, are an integer from 1 to 3; and $X^-$ is a softener compatible anion.

The percentages, by weight, of mono, di, and tri esterquats, as described above are determined by the quantitative analytical method described in the publication "Characterisation of quaternized triethanolamine esters (esterquats) by HPLC, HRCGC and NMR" A. J. Wilkes, C. Jacobs, G. Walraven and J. M. Talbot—Colgate Palmolive R&D Inc.—4$^{th}$ world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the percentage of saturated fatty acids based on the total weight of fatty acids is 45 to 75%. Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard:soft fatty acid.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

The fatty acids can be any fatty acid that is used for manufacturing esterquats for fabric softening. Examples of fatty acids include, but are not limited to, coconut oil, palm oil, tallow, rape oil, fish oil, or chemically synthesized fatty acids. In certain embodiments, the fatty acid is tallow.

While the esterquat can be provided in solid form, it is usually present in a solvent in liquid form. In solid form, the esterquat can be delivered from a dryer sheet in the laundry. In certain embodiments, the solvent comprises water.

AI refers to the active weight of the combined amounts for monoesterquat, diesterquat, and triesterquat. Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally. In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

The cationic fabric conditioner, such as esterquat, can be present in an amount of 0.5 to 20% by weight of the composition. In other embodiments, the amount is 1 to 20, 1 to 15, or 1 to 10% by weight.

The composition can be provided as a fragrance free composition, or it can contain a fragrance. The amount of fragrance can be any desired amount depending on the preference of the user. In certain embodiments, the total amount of fragrance oil is 0.3 to 3 weight % of the composition. The fragrance can be in free form, encapsulated, or both.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The composition can contain any material that can be added to fabric softeners. Examples of materials include, but are not limited to, surfactants, thickening polymers, colorants, clays, buffers, silicones, fatty alcohols, and fatty esters.

The fabric conditioners may additionally contain a thickener. In one embodiment, the thickening polymer is the FLOSOFT™ DP200 polymer from SNF Floerger that is described in U.S. Pat. No. 6,864,223 to Smith et al., which is sold as FLOSOFT™ DP200, which as a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. These polymers are further described in U.S. Pat. No. 4,806,345, and other polymers that may be utilized are disclosed in WO 90/12862. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener is a cross-linked copolymer of a quaternary ammonium acrylate or methacrylate in combination with an acrylamide comonomer. The thickener in accordance provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™ 2000 from Monsanto. In other embodiments, the composition can include glutamic acid, N,N-diacetic acid, tetra sodium salt, which is available as Dissolvine™ GL from AkzoNobel.

In certain embodiments, the composition can include a $C_{13}$-$C_{15}$ Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

In certain embodiments, the composition can additionally contain cetyl trimethyl ammonium chloride. In certain embodiments, cetyl trimethyl ammonium chloride is present in an amount of 0.001 to 5 weight %. When included, the cetyl trimethyl ammonium chloride in combination with the branched amine functional silicone reduces foam generation during laundering, which reduces the amount of rinsing needed.

In certain embodiments, the composition reduces the number of wrinkles by at least 5, 10, 15, 20, 25, 30, 35, 40, 45, 50, 55, 60, 65, 70, 75, 80, 85, 90, or 95% as compared to the number of wrinkles without the use of the water soluble silicone. Wrinkle evaluation can be conducted as per DIN 53890.

SPECIFIC EMBODIMENTS

In the examples below, the amounts of material are based on the as supplied weight of the material.

| Material (weight %) | Comparative | Example |
|---|---|---|
| Tetranyl ™ AHT5090 Esterquat from Kao | 6.7 | 6.7 |
| Lactic acid (80% active) | 0.0625 | 0.0625 |
| Dequest ™ 2000 amino trimethyl phosphonic acid | 0.1 | 0.1 |
| FLOSOFT ™ DP200 thickening polymer | 0.2 | 0.2 |
| Silicone 1086 defoamer | 0.12 | 0.12 |
| C14-15 Alcohol ethoxylate 20EO | 0.4 | 0.4 |
| The amino-functional, epoxide group containing silicone polymer (35% active) | 0 | 0.7 |
| The branched amine functional silicone polymer (30% active) | 0 | 1 or 2 |
| Water and minors (fragrance, preservative, color) | Q.S. to 100 | Q.S. to 100 |

Example 1—Fast Dry Benefit

Preparation Method

Weigh required amount of distilled water in a beaker. Add amino trimethyl phosphonic acid and lactic acid to water and mix. Heat to 40° C. Stir the solution using an overhead stirrer at 250 RPM for 2 minutes. In a beaker, heat esterquat to 65° C. Add esterquat into solution while stirring at 400 RPM. Mix the solution for 10 minutes. Add SNF™ polymer into the solution and stir for 10 minutes. Add the polyether polymer into solution while stirring at 250 RPM. Mix the solution for 5 minutes. Check the temperature of the mixture. On cooling to room temperature, add any fragrance drop wise.

Fabric Treatment with Fabric Softener

Prepare an approximate 1.8 kg load containing 5 denim swatches (100% cotton denim, 35×35 cm long, approximately 50 g per swatch) with 1.6 kg of ballast load, per product to be tested (washing machine).

Weigh each Swatch and record measurement

Using a marking pen, label swatches with respective product identification code.

Weigh out detergent samples and fabric softener for each wash.

Washing machine(s) should be cleaned by conducting a wash cycle.

Washer Type: Top Load

Wash Cycle: Normal Cycle

Wash Time: 55 minutes

Water Level: 43 liters used for each wash and rinse cycles

Wash Temperature: Room Temperature

Rinse Temperature: Room Temperature

Laundry Load Size: 1.8 Kg

Detergent: Ariel™ Oxianillos detergent from Mexico

Dosage: 90 g

Fabric Softener: 110 g

Set wash controls for custom cycle with specified wash period. Add detergent and fabric softener to respective compartments in washing machine. Add swatches and ballast load to washing machine.

Start wash cycle

Wash for specified amount of time

Remove wash load & swatches for hand wash rinsing.

All the garments treated are rinsed and hung to dry without wringing. The garment are allowed to hang for 5 Minutes to drip the excess of water and then weighed.

35 cm denim swatches are evaluated during the experiment (35 cm×35 cm). Up to 5 denim swatches are evaluated per treatment as repetitions in order to avoid the experimental error. The percent water retained is shown below compared to a fabric conditioner without the polymer and a comparative of rinsing with water. The results are in Table 1 below.

TABLE 1

| AI Level % | Amine functional silicone polymer (wt. %) | Amino-functional, epoxide group containing silicone polymer (wt. %) | % Water Retention |
|---|---|---|---|
| 4 | 0 | 0 | 112.5 |
| 4 | 2 | 0 | 111.8 |
| 4 | 0 | 0.7 | 107.5 |
| 4 | 2 | 0.7 | 102.3 |
| 6 | 0 | 0 | 115.5 |
| 6 | 2 | 0 | 109.7 |
| 6 | 0 | 0.7 | 110.3 |
| 6 | 2 | 0.7 | 99.8 |

It can be seen from the table above that the combination of the two polymers reduces the percent water retention over either alone or to a control fabric conditioner without the polymers.

The % Water Retention is calculated based in the following formula $$\%\ \text{Water Retention} = \frac{(WeightWet - WeightDry)}{WeightDry}$$

Example 2—Color Fading

Black Cotton fabric is consecutive washed up to 100 washes to assess the performance of three treatments, washing with detergent alone, washing with the fabric conditioner formula above without the amino-functional, epoxide group containing silicone polymer and the branched amine functional silicone, and a fabric conditioner with both polymers. In order to assess the color fading damage, every 20 washes a swatch of 10 cm×10 cm is cut and retained to later assess the damage. Once the 100 washes were completed, every swatch is evaluated for color fading with the use of the HunterLAB XE, and evaluated the $\Delta E_{cmc}$ according to the software and the Color Theory to assess the color fading. The results are in Table 2 below.

TABLE 2

| | Treatment $\Delta E_{cmc}$ Color | | |
|---|---|---|---|
| Wash | Detergent Only | Conditioner without polymers | Inventive Conditioner |
| 20 | 2.72 | 2.5 | 1.89 |
| 40 | 6.94 | 6 | 4.54 |
| 60 | 10.1 | 9 | 7.22 |
| 80 | 16.36 | 14 | 10.22 |
| 100 | 19.76 | 18 | 13.24 |

As can be seen in the table above, the inventive composition has less color fading compared to a fabric conditioner without the polymers or to detergent alone.

Example 3—Pilling

Polyester fabric is consecutive washed up to 100 washes to assess the performance of three treatments, washing with detergent alone, washing with the fabric conditioner formula above without the amino-functional, epoxide group containing silicone polymer and the branched amine functional silicone of structure, and a fabric conditioner with both polymers. In order to assess the pilling damage, every 20 washes a swatch of 10 cms×10 cms was cut and retained to later assess the damage. Once the 100 washes were completed, a panel of 6 people visually assess the performance of the fabrics and scored according to a 5 point scale the pilling damage on the polyester fabric. The average ratings of the panelists are in the table below. The scale is 1 is no pilling, 2 is slight pilling, 3 is moderate pilling, 4 is severe pilling, and 5 is very severe pilling. The results are in Table 3 below.

TABLE 3

| Treatment Pilling Score | | | |
|---|---|---|---|
| Wash | Detergent | Conditioner without polymers | Inventive Conditioner |
| 20 | 2.7 | 2. | 1.2 |
| 40 | 4.0 | 3.0 | 1.8 |
| 60 | 4.3 | 4.2 | 3.2 |
| 80 | 4.5 | 4.5 | 4.2 |
| 100 | 5.0 | 4.5 | 4.5 |

As can be seen in the table above, the inventive composition has less pilling up to 80 washes compared to a fabric conditioner without the polymers or to detergent alone.

Example 4—Ease of Ironing

In this example, the conditioner formula above without either polymer is compared to a conditioners with one of the polymers and an inventive with both of the polymers.

Prepare an approximate 2 kg load containing 5 denim swatches (Kaltex 100% cotton denim, 175 cm long, approximately 400 g per swatch) without ballast, per product to be tested (washing machine).

Using a marking pen, label swatches with respective product & type of drying identification code.

Weigh out detergent samples and fabric softener for each wash.

Washing machine(s) should be cleaned by conducting a wash cycle at 70° C.

Washer Type: Front Loading

Wash Cycle: Custom—40° C., "Fast" Centrifugation

Wash Time: 77 minutes

Water Level: 23 liters used for all wash and rinse cycles

Wash Temperature: 40° C.

Rinse Temperature: Room Temperature

Spin Speed: 1200 RPM

Laundry Load Size: 2 Kg

Drying: Dryer or line drying overnight

Detergent: Ariel™ Professional detergent from Europe

Dosage: 80 g

Fabric Softener: 110 g

Set wash controls for custom cycle with specified wash period. Add detergent and fabric softener to respective compartments in washing machine. Add swatches to washing machine.

Start wash cycle

Wash for specified amount of time

Remove wash load

The swatches that are line dried are dried on lines overnight, otherwise, they are dried in a dryer.

After washing and drying, the fabric is tested for Ease of Ironing according to the following test.

The apparatus contains a table, a Black & Decker electric iron that is attached to a string, a mixer for pulling and winding the string, and a dynamometer mounted to the top of the iron. The weight of the iron with the dynamometer is 102.2 grams.

A piece of fabric that is about 175 cm in length is laid on the table and clamped down.

The iron is turned on to 50% of the maximum temperature setting and allowed to reach operating temperature. The temperature during use is measured to ensure the temperature is 190±10° C.

The iron is placed at one end of the fabric.

The mixer is started to pull the string and iron down the fabric. The mixer runs at about 36.5 rpm to provide a speed of about 0.4 cm/s.

At 20, 40, 60, 80, and 100 cm down the fabric, the reading on the dynamometer is taken.

After all five measurements are taken, the results are averaged. This is recorded as stroke 1.

The iron is again placed at the end of the fabric and pulled down the fabric.

At 20, 40, 60, 80, and 100 cm down the fabric, the reading on the dynamometer is taken.

After all five measurements are taken, the results are averaged. This is recorded as stroke 2.

Below are the average of stroke 1 and stroke 2 results after 5 wash cycles for the fabric.

TABLE 4

| | AI | Average Force (gram-force) |
|---|---|---|
| Conditioner Only | 4 | 109.1 |
| Conditioner with amino-functional, epoxide group containing silicone polymer (0.7 wt % supplied) | 4 | 107.3 |
| Conditioner with amine functional silicone (2 wt. % supplied) | 4 | 114.6 |
| Conditioner with both polymers | 4 | 104.2 |

It can be seen that the inclusion of both polymers reduces the force needed for ironing over either polymer alone or a formula with no polymer.

Example 5—Reduction of Wrinkles

The above fabric conditioner formula is prepared with the following modifications

| Sample | Esterquat Wt. % | The amino-functional, epoxide group containing silicone polymer (35% active) Wt. % as supplied | The branched amine functional silicone polymer (30% active) Wt. % as supplied |
|---|---|---|---|
| 1 | 4.5 | 0.55 | 0.8 |
| 2 | 5 | 0.55 | 1 |
| 3 | 5 | 0.9 | 1.1 |
| Comparative | 5 | 0 | 0 |

Prepare an approximate 1.8 kg load containing 3 denim swatches (Kaltex 100% cotton denim, 200 mm×200 mm) without ballast, per product to be tested (washing machine).

Swatches washed with an automatic washing machine using the composition of the Example in the fabric softener cycle. As a comparison, another set of the swatches are also washed but without adding the fabric treatment composition of the present invention.

Using a marking pen, label swatches with respective product & type of drying identification code.

Weigh out detergent samples and fabric softener for each wash.

Washing machine(s) should be cleaned by conducting a wash cycle at 70° C.

Washer Type: Front Loading

Wash Cycle: Custom—40° C., "Fast" Centrifugation

Wash Time: 8 minutes

Water Level: 45 liters used for all wash and rinse cycles

Wash Temperature: 40° C.

Rinse Temperature: Room Temperature

Spin Speed: 1200 RPM

Laundry Load Size: 1.8 Kg

Detergent: Ariel™ Professional detergent from Europe

Dosage: 33 g

Fabric Softener: 77 g

Set wash controls for custom cycle with specified wash period. Add detergent and fabric softener to respective compartments in washing machine. Add swatches to washing machine.

Start wash cycle

Wash for specified amount of time

Wrinkles on Fabrics

The washing machine is stopped just before the last spinning cycle, and the swatches are removed from the washing machine. Each swatch is folded twice length wise, and hand wrung to remove water. The wrung swatch is opened and shaken three times by grabbing two corners of the swatch. Swatches are returned to the final spin cycle. Swatches are removed and hung to dry. Each dried swatch is evaluated for the number of visually perceptive wrinkles within a 60 $cm^2$ circle at the center of the swatch. The table below lists the average number of wrinkles.

TABLE 5

| Sample | Wrinkle evaluation |
|---|---|
| Control | 27.7 |
| 1 | 7.96 |
| 2 | 9.63 |
| 3 | 9.56 |

As can be seen from the data, inclusion of both polymers into the fabric conditioner reduces the wrinkles formed during laundering.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. A fabric conditioner composition comprising an amino-functional, epoxide group containing silicone polymer having a weight average molecular weight of 400,000 to 900,000 and a branched amine functional silicone, wherein the branched amine functional silicone has a structure of

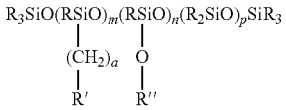

R is a $C_1$-$C_4$ alkyl group,

R' is an amine or salt thereof,

R" is $(R_2SiO)_xNH_2$ or $(R_2SiO)_y(RSiO)_w[(CH_2)_3R']_z$, a is 1 to 10, m is 1 to 5, n is 3 to 20, p is 300 to 500, x is 50 to 200, y is 20 to 100, w is 0 to 10, z=w+1; and x+y+w+z+p=500 to 700.

2. The fabric conditioner of claim 1, wherein the branched amine functional silicone has a weight average molecular weight of 50,000 to 70,000.

3. The fabric conditioner of claim 1, wherein the branched amine functional silicone is not a film forming polymer.

4. The fabric conditioner of claim 1, wherein at least 80% of R groups in (RSiO) or $(R_2SiO)$ moieties are methyl.

5. The fabric conditioner of claim 1, wherein the amine is selected from the group consisting of $—NH_2$, NHR, $—N(R)_2$, $—NH—(CH_2)_b—NH_2$, and $—N(R)_3^+$, wherein b is 1 to 6.

6. The fabric conditioner of claim 1, wherein the amine is $—NH_2$.

7. The fabric conditioner of claim 1, wherein R" is $(R_2SiO)_x$.

8. The fabric conditioner of claim 1, wherein the branched amine functional silicone is present in an amount of 0.02 to 2% by weight of the composition.

9. The fabric conditioner of claim 1, wherein the amino-functional, epoxide group containing silicone polymer comprises 3-aminopropyl-5,6 epoxycyclohexylethyl-dimethyl polysiloxane.

10. The fabric conditioner of claim 1, wherein the amino-functional, epoxide group containing silicone polymer has a weight average molecular weight of at least 450,000 to 850,000.

11. The fabric conditioner of claim 1, wherein a ratio of the amino-functional, epoxide group containing silicone polymer to a total of all groups in the polymer is from 1:300 to 1:500.

12. The fabric conditioner of claim 1, wherein the amino-functional, epoxide group containing silicone polymer has an amine content of 0.1 to 0.25 meq/g.

13. The fabric conditioner of claim 1, wherein the amino-functional, epoxide group containing silicone polymer is present in the composition in an amount of 0.02 to 0.5% by weight of the composition.

14. The fabric conditioner of claim 1 further comprising a cationic fabric softener.

15. The fabric condition of claim 14, wherein, the cationic fabric softener is present in an amount of 0.5 to 20% by weight of the composition.

16. The fabric conditioner of claim 14, wherein the cationic fabric softener is an esterquat.

17. The fabric conditioner of claim 14, wherein the amino-functional, epoxide group containing silicone polymer is in the form of an emulsion that is mixed with the cationic fabric softener.

18. The fabric conditioner of claim 17, wherein the emulsion comprises the amino-functional, epoxide group containing silicone polymer and at least one surfactant chosen from cationic surfactants and nonionic surfactants.

19. The fabric conditioner of claim 1, wherein the composition is an aqueous composition.

20. A method for reducing time needed for drying fabric comprising laundering the fabric with the composition of claim 1.

21. The method of claim 20, wherein the laundering is at least 3 times.

22. A method for reducing color fading of fabric during laundering the fabric comprising laundering the fabric with the composition of claim 1.

23. A method for reducing pilling of fabric during laundering the fabric comprising laundering the fabric with the composition of claim 1.

24. A method for reducing force needed for ironing a fabric comprising laundering the fabric with the composition of claim 1.

25. A method of reducing wrinkles in fabric during laundering comprising laundering the fabric with the composition of claim 1.

* * * * *